United States Patent [19]

Arias

[11] 4,314,005

[45] Feb. 2, 1982

[54] PROCESS FOR COATING FERROUS METAL ARTICLES AND RESULTING ARTICLES

[76] Inventor: José V. Arias, Apartado 51950 1050A, Caracas, Venezuela

[21] Appl. No.: 158,757

[22] Filed: Jun. 12, 1980

[51] Int. Cl.[3] ..... B32B 15/04

[52] U.S. Cl. ..... 428/467; 427/318; 427/435; 427/443; 428/469; 428/472

[58] Field of Search ..... 427/318, 228, 443, 435; 428/472, 469, 467

*Primary Examiner*—Ralph S. Kendall

*Attorney, Agent, or Firm*—Sughrue, Mion, Zinn, Macpeak & Seas

[57] ABSTRACT

A process is described for thermo-chemically coating ferrous metal articles, especially small intricate ferrous articles. The process involves preparing a coating composition for homogenizing a complex of metal oxides and other solids in an organic liquid composition to obtain an emulsion, pre-heating the ferrous articles to an elevated temperature, immersing the pre-heated ferrous articles in the coating composition, withdrawing the articles and allowing them to cool.

7 Claims, No Drawings

PROCESS FOR COATING FERROUS METAL ARTICLES AND RESULTING ARTICLES

BACKGROUND

1. Field of the Invention

The invention relates to the protection to ferrous articles from oxidation and corrosion or the acquisition of a surface excess of carbon transmitted by the atmosphere using a thermochemical treatment including pre-heating the ferrous articles followed by immersion in a coating composition comprising an intimate dispersion or emulsion of a complex of metal oxides in a mixture of organic liquids.

2. Description of the Prior Art

A process for protecting ferrous metals and products is described in Spanish Patent Application Ser. No. 441,498 filed Oct. 3, 1975 for Thermochemical Procedure for Coating of Ferrous Metals. In that application there is disclosed a process for treating ferrous articles to keep them in their natural state of ductility while at the same time preserving them from rust, corrosion and deformation of the ferrite A, B and Y. The procedure comprised (a) thoroughly mixing the following materials: 300 grams of magnesium oxide, 100 grams of zinc oxide, 50 grams of lead dioxide, 50 grams of lead pentoxide, 100 grams of chromium oxide, 100 grams of aluminum oxide, 150 grams of manganese oxide, 150 grams of cobalt oxide;

(b) thoroughly dispersing or emulsifying the mixture of step (a) in a mixture of 1 liter of neatsfoot oil, 2 liters of African palm oil, 4 liters of transmission oil of 160 or 170 density;

(c) pre-heating the ferrous articles which are to be treated to a temperature of 520° C.;

(d) contacting the pre-heated ferrous articles of step (c) with the mixture of step (b) for a short time, i.e., approximately 30 seconds; and (e) removing the articles from the mixture of step (b) and allowing them to cool.

The present invention comprises improvements in the foregoing process and products whereby greater penetration of the treatment into the surface of the ferrous metal article is achieved.

SUMMARY OF THE INVENTION

The present invention comprises treating ferrous articles to protect the articles from oxidation and corrosion or the acquisition of a surface excess of carbon transmitted from the atmosphere, while at the same time preventing both the loss of natural ductility and the deformation of the ferrite A, B and Y. The invention also contemplates ferrous articles having a surface coating or modified surface layer produced by treatment in accordance with the process of the invention.

The process is described below with respect to a practical example, but the particular amounts specified therein can be varied within the scope of the invention. The process, then, comprises the following general steps:

(1) thoroughly mixing powders of the following ingredients:

| | |
|---|---|
| magnesium oxide | 450 grams ± 10% |
| zinc oxide | 170 grams ± 10% |
| lead dioxide | 80 grams ± 10% |

-continued

| | |
|---|---|
| lead pentoxide | 80 grams ± 10% |
| chromium oxide | 170 grams ± 10% |
| aluminum oxide | 200 grams ± 10% |
| manganese oxide | 240 grams ± 10% |
| cobalt oxide | 250 grams ± 10% |
| vanadium oxide | 200 grams ± 10% |
| copper oxide | 309 grams ± 10% |
| powdered lithium | 250 grams ± 10% |
| sodium hyposulphite | 185 grams ± 10% |

to form a uniform mixture thereof;

(2) thoroughly mixing the mixture of step (1) with a mixture of the following ingredients:

| | |
|---|---|
| neatsfoot oil | 3 liters ± 10% |
| African palm oil | 5 liters ± 10% |
| heavy transmission oil of 160 to 170 density | 9.5 liters ± 10% |
| creosote | 3 liters ± 10% |

to form a uniform composition of the powder mixture of step (1) in the liquid mixture of step (2).

(3) pre-heating a ferrous article to be treated to a temperature of about 678° C., and preferably 678°–680° C. in an oven with an oxidizing flame.

(4) immersing the pre-heated ferrous article in or otherwise contacting the surfaces of the pre-heated ferrous article with the composition formed in step (2) for a minimum of 30 seconds, and preferably for a period from about 30 to 90 seconds.

(5) removing the ferrous article from contact with the composition formed in step (2) and allowing the article to cool.

Compared with the method of Spanish Patent Application, Ser. No. 441,498, I have found in accordance with the present process that increased penetration of the treatment into the surface of the ferrous articles is achieved, due to several factors, including the presence of vanadium oxide, lithium powder, and sodium hyposulphite in the mixture of step (1), the addition of creosote to the oil mixture of step (2), and the use of higher temperatures. Also the use of a larger volume of the solids/liquids mixture for treating articles of the same size as has been treated by the process of Spanish Patent Application Ser. No. 441,498 mitigates against any adverse effects from the use of the higher temperature, e.g., softening of the ferrous articles treated, and provides better stability and efficacy in the process.

DETAILED DESCRIPTION OF THE INVENTION

A preferred embodiment of the invention comprises the treatment of complex or intricately shaped ferrous articles such as might be produced by forging, welding or otherwise forming ferrous metal, for use, e.g., in jewelry making or for the production of parts for mechanical or electromechanical devices. For instance, ferrous articles such as screws, nuts, etc., which may be exposed to weather or used underwater can be treated according to the process of the invention.

Any ferrous article can be treated by the present invention, provided that iron is the main component thereof.

The preparation of the treating composition need not follow any particular order. Any method for emulsifying the complex of metal oxides and other solids in the liquids may be used. I have found it preferable in the interest of efficiency to first separately mix the solids and liquids, and then to blend the respective mixtures together until an intimate emulsion is produced. A standard stainless-steel mechanical agitator is used for the purpose, e.g., an agitator operated by an electric motor at 1400–1500 rpm. Blending is continued until all of the solids are intimately mixed and emulsified in the liquids, typically a period of about an hour and a half. While it is probably feasbile to mix the solids individually into the liquids, or to add the liquids incrementally to the solids mixture, or to follow other mixing procedures, such alternatives would appear to make it difficult to obtain a homogeneous emulsion and the most efficient procedure of which I am aware is to add the premixed solids to the premixed liquids or vice versa and then to mix the combined materials.

EXAMPLE (1) Preparation of Solids Mixture

A mixture of powdered solids is prepared containing the following ingredients:

450 grams of magnesium oxide
170 grams of zinc oxide
80 grams of lead dioxide
80 grams of lead pentoxide
170 grams of chromium oxide
200 grams of aluminum oxide
240 grams of manganese oxide
250 grams of cobalt oxide
200 grams of vanadium oxide
309 grams of copper oxide
250 grams of powdered lithium
185 grams of sodium hyposulfite (2)(a) Preparation of Liquids Mixture A preferred mixture of liquids is prepared containing the following ingredients:

3 liters of neatsfoot oil
5 liters of African palm oil
9.5 liters of transmission oil of 160 or 170 density
3 liters of creosote (2)(b) Mixture of Solids and Liquids The solids mixture of step (1) is then stirred into the liquids mixture of step (2)(a) using the same stainless-steel mechanical agitator as is used to mix the solids, for a period of an hour and a half, until the solids mixture is intimately mixed and emulsified in the liquid of step (2)(a).

(3) Preheating the Ferrous Article

The ferrous article to be treated is placed in a rectangular oven fired by liquid fuel and having an oxidizing flame impinging on the ferrous article. The article is heated until a temperature of 678° C. is reached.

(4) Contacting the Pre-Heated Article With the Solids/Liquids Mixture

The ferrous article, pre-heated to 678° C. is then removed from the oven and quickly immersed in the solids/liquid emulsion composition prepared in accordance with procedure (2)(b) above. In some cases only partial immersion of the heated article may be needed or desired where only part of the article is to be treated, but the usual procedure is to immerse the article completely in the solids/liquids composition. The duration of immersion is approximately 30 seconds. The duration of immersion for only a short period on the order of at least about 30 seconds is necessary to achieve the desired effect. Preferably, the maximum period of immersion should not exceed 90 seconds.

(5) Cooling the Treated Article

After removal from the solids/liquid composition the article is removed to a place substantially free from air currents and is allowed to cool to ambient (room) temperature. Other methods of cooling may be employed but I believe it best to allow the article to cool slowly, in air, without the direct application of air currents or other cooling fluids or cooling means.

What is claimed is:

1. A process for thermo-chemically coating ferrous metal articles, comprising:

(1) forming a uniform composition consisting essentially of:
(a) 450 grams±10% of magnesium oxide
(b) 170 grams±10% of zinc oxide
(c) 80 grams±10% of lead dioxide
(d) 80 grams±10% of lead pentoxide
(e) 170 grams±10% of chromium oxide
(f) 200 grams±10% of aluminum oxide
(g) 240 grams±10% of manganese oxide
(h) 250 grams±10% of cobalt oxide
(i) 200 grams±10% of vanadium oxide
(j) 309 grams±10% of copper oxide
(k) 250 grams±10% of powdered lithium
(l) 185 grams±10% of sodium hyposulphite
(m) 3 liters±10% of neatsfoot oil
(n) 5 liters±10% of African palm oil
(o) 9.5 liters±10% of heavy transmission oil of 160 to 170 density
(p) 3 liters±10% of creosote;

(2) pre-heating a ferrous article to be treated to a temperature of about 678° C. in an oven with an oxidizing flame;

(3) immersing the pre-heated ferrous article in, or otherwise contacting the surfaces of the pre-heated ferrous article with, the composition formed in step (1) for a minimum of 30 seconds; and (4) removing the ferrous article from contact with the composition formed in step (1) and allowing the article to cool.

2. A process as in claim 1 wherein the ferrous article is pre-heated to a temperature of 678° C. to 680° C.

3. A process as in claim 1, wherein the pre-heated ferrous article is immersed in, or otherwise contacted on the surfaces thereof with, the composition formed in step (2) for a period of between 30 and 90 seconds.

4. A process for thermo-chemically coating ferrous metal articles comprising:

(1) thoroughly mixing powders of:
(a) 450 grams±10% of magnesium oxide
(b) 170 grams±10% of zinc oxide
(c) 80 grams±10% of lead dioxide
(d) 80 grams±10% of lead pentoxide
(e) 170 grams±10% of chromium oxide
(f) 200 grams±10% of aluminum oxide
(g) 240 grams±10% of manganese oxide
(h) 250 grams±10% of cobalt oxide
(i) 200 grams±10% of vanadium oxide
(j) 309 grams±10% of copper oxide
(k) 250 grams±10% of powdered lithium
(l) 185 grams±10% of sodium hyposulphite (2) thoroughly mixing the mixture of step (1) with a mixture of:
(a) 3 liters±10% of neatsfoot oil
(b) 5 liters±10% of African palm oil
(c) 9.5 liters±10% of heavy transmission oil of 160 to 170 density (d) 3 liters±10% of creosote to form a uniform composition of the powder mixture of step (1) in the liquid mixture of step (2);

(3) pre-heating a ferrous article to be treated to a temperature of about 678° C. in an oven with an oxidizing flame;

(4) immersing the pre-heated ferrous article in, or otherwise contacting the surfaces of the pre-heated ferrous article with, the composition formed in step (2) for a minimum of 30 seconds; and (5) removing the ferrous article from contact with the composition formed in step (2) and allowing the article to cool.

5. A process as in claim 4 wherein the ferrous article is pre-heated to a temperature of 678° C. to 680° C.

6. A process as in claim 4 wherein the pre-heated ferrous article is immersed in, or otherwise contacted on the surfaces thereof with, the composition formed in step (1) for a period of between 30 and 90 seconds.

7. A ferrous metal article thermo-chemically coated by the process of claim 1, 2, 3, 4, 5, or 6.

* * * * *